US005950963A

United States Patent [19]

Speicher et al.

[11] Patent Number: 5,950,963

[45] Date of Patent: Sep. 14, 1999

[54] FIN LOCK MECHANISM

[75] Inventors: John M. Speicher; Che-Ram S. Voigt, both of Geyserville; Craig D. Perry, Santa Rosa; Allan A. Voigt, Geyserville, all of Calif.

[73] Assignee: Versatron Corporation, Healdsburg, Calif.

[21] Appl. No.: 08/948,035

[22] Filed: Oct. 9, 1997

[51] Int. Cl.[6] ..... F41G 7/00; F42B 10/00

[52] U.S. Cl. ..... 244/3.21; 244/3.24

[58] Field of Search ..... 244/3.21, 3.24, 244/3.25, 3.26, 3.27, 3.28, 3.29, 3.3

[56] References Cited

U.S. PATENT DOCUMENTS

| | | | |
|---|---|---|---|
| 3,093,075 | 6/1963 | Garrett et al. | 244/3.24 |
| 3,711,040 | 1/1973 | Carver | 244/3.21 |
| 4,795,110 | 1/1989 | Lang | 244/3.21 |
| 4,884,766 | 12/1989 | Steinmetz et al. | 244/3.27 |
| 5,040,745 | 8/1991 | Oswald et al. | 244/3.21 |
| 5,439,188 | 8/1995 | Depew, Jr. et al. | 244/3.21 |
| 5,480,111 | 1/1996 | Smith et al. | 244/3.27 |
| 5,505,408 | 4/1996 | Speicher et al. | 244/3.24 |
| 5,551,793 | 9/1996 | Lewis | 244/3.25 |
| 5,593,109 | 1/1997 | Williams | 244/3.21 |

*Primary Examiner*—Charles T. Jordan
*Assistant Examiner*—Theresa M. Wesson
*Attorney, Agent, or Firm*—Henry M. Bissell

[57] ABSTRACT

A mechanism for locking the fins of a missile in place when the missile is not in use utilizes tabs inserted in slots of the output shafts of the fins to immobilize the output shafts and the fins. In one embodiment, the tabs are cantilevered on a locking plate from which they extend radially toward the output shafts. A cam plate slidably engages the tabs on the locking plate and simultaneously lifts all the tabs out of the slots when it is rotated. for disengagement of the locking mechanism. Operation of the locking mechanism can be effected either manually, using a specialized tool, or remotely, using for example a pyrotechnic actuation device.

12 Claims, 3 Drawing Sheets

FIN LOCK MECHANISM

BACKGROUND OF THE INVENTION

1. Field of the Invention

The invention relates to a mechanism for locking the steering fins of a missile in place when the missile is not in use. The mechanism immobilizes the output shafts of the missile steering fins and is disengaged when the missile is ready for launch.

2. Description of the Related Art

U.S. Pat. No. 5,505,408 to John M. Speicher, Allan A. Voigt and Che-Ram S. Voigt, assigned to the same assignee as the present invention, shows a missile control system which effects steering of a missile using rotatable fins. The disclosure of that patent is incorporated herein by reference. In that disclosure, relying on dynamic pressure, pairs of fins disposed on opposite sides of a missile are rotated in unison to achieve yaw and pitch motion and in opposition to achieve roll motion during flight. The fins are rotated by output shafts to which they are connected, which output shafts extend into the missile and engage corresponding actuator motors via associated gear linkages. The motors are responsive to command signals issued by the missile autopilot and thereby effect steering control of the missile.

The steering fins of a missile are critical components whose proper function is crucial to the navigation and stability of the craft. Accurate flight of the missile depends on precise alignment of these components, and reducing their susceptibility to mis-alignment during pre-flight handling of the missile is important.

Locking the missile fins in place when the missile is not in use reduces the possibility of mis-alignment and wear on the missile fins and related components. Moreover, such immobilization of the missile fins facilitates pre-flight handling of the missile. Another important reason for locking the fins is to prevent damage to the actuator during air carry when the missile is carried external to the aircraft. Aerodynamic loads resulting from high speed flight could cause the fins to move which in turn might damage the actuator or the aircraft. A light weight, simple device for this purpose, which has a minimal number of moving parts and which is readily and simultaneously disengageable from all the fins, would therefore improve missile reliability and performance.

SUMMARY OF THE INVENTION

In accordance with the invention, a fin lock mechanism for immobilizing the output shafts of the fins in a Control Actuator System (CAS) is provided. In the preferred embodiment, the locking mechanism is comprised of a rigidly mounted locking plate having a series of tabs extending therefrom toward the fin output shafts. The tabs are cantilevered on resilient arms of the locking plate, which resilient arms operate as springs to pre-load the tabs into slots formed on the bevel gears which rotate the fin output shafts. The pre-loaded tabs extending from the rigidly mounted locking plate serve to prevent rotation of the output shafts, effectively locking the output shafts and fins in position.

To unlock the fins, a rotatably mounted cam plate operates to lift the cantilevered tabs out of the slots in the output shaft bevel gears. Engagement segments disposed on the cam plate slide along ramps provided on the locking plate when the cam plate is rotated. The ramps, rigidly connected to the cantilevered tabs, are lifted by the sliding action of the engagement segments against the ramp surfaces as the cam plate rotates, causing concurrent lifting of the tabs out of the slots in the output shaft bevel gears and disengagement of the locking mechanism.

Two methods to rotate the cam plate and disengage the locking mechanism are contemplated. The first uses a key-like special tool and allows an operator to manually unlock and lock the fins, and may be particularly suitable for missile testing and servicing situations. The second method employs pyrotechnic devices that can be electrically triggered by appropriate commands. The pyrotechnic devices drive pistons which engage contact points on the cam plate to thereby impart the requisite rotary motion.

In a second embodiment of the invention, use is made of a rotating actuator ring which pushes the tabs into and out of slots ill the output shaft bevel gears. Rather than being located on a locking plate, the tabs are disposed on the ends of individual arms which are anchored at their opposite ends to stationary portions of the missile. The arms in this manner can swing between a locking position and an unlocking position and are actuated by the rotary motion of the actuator ring which is mechanically linked thereto. Rotation of the actuator ring, like that of the cam plate described above, is effected either manually or via a pyrotechnic device.

BRIEF DESCRIPTION OF THE DRAWINGS

A better understanding of the present invention may be realized from a consideration of the following detailed description, taken in conjunction with the accompanying drawings, in which.

DESCRIPTION OF THE PREFERRED EMBODIMENTS

Figure 1:
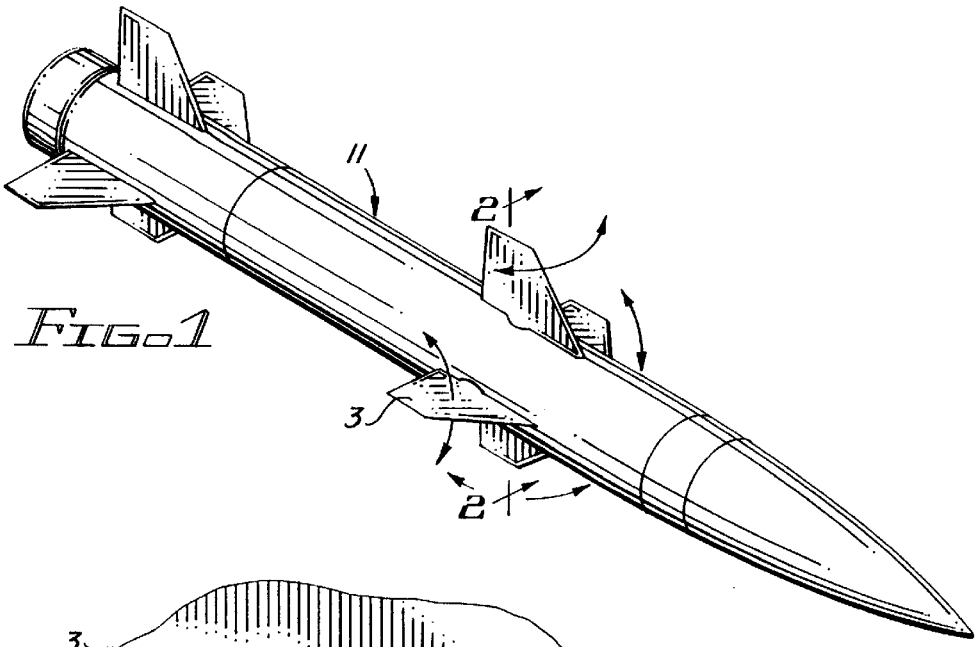
FIG. 1 is an operational view of a missile with rotatable aerofins.
Figure 2:
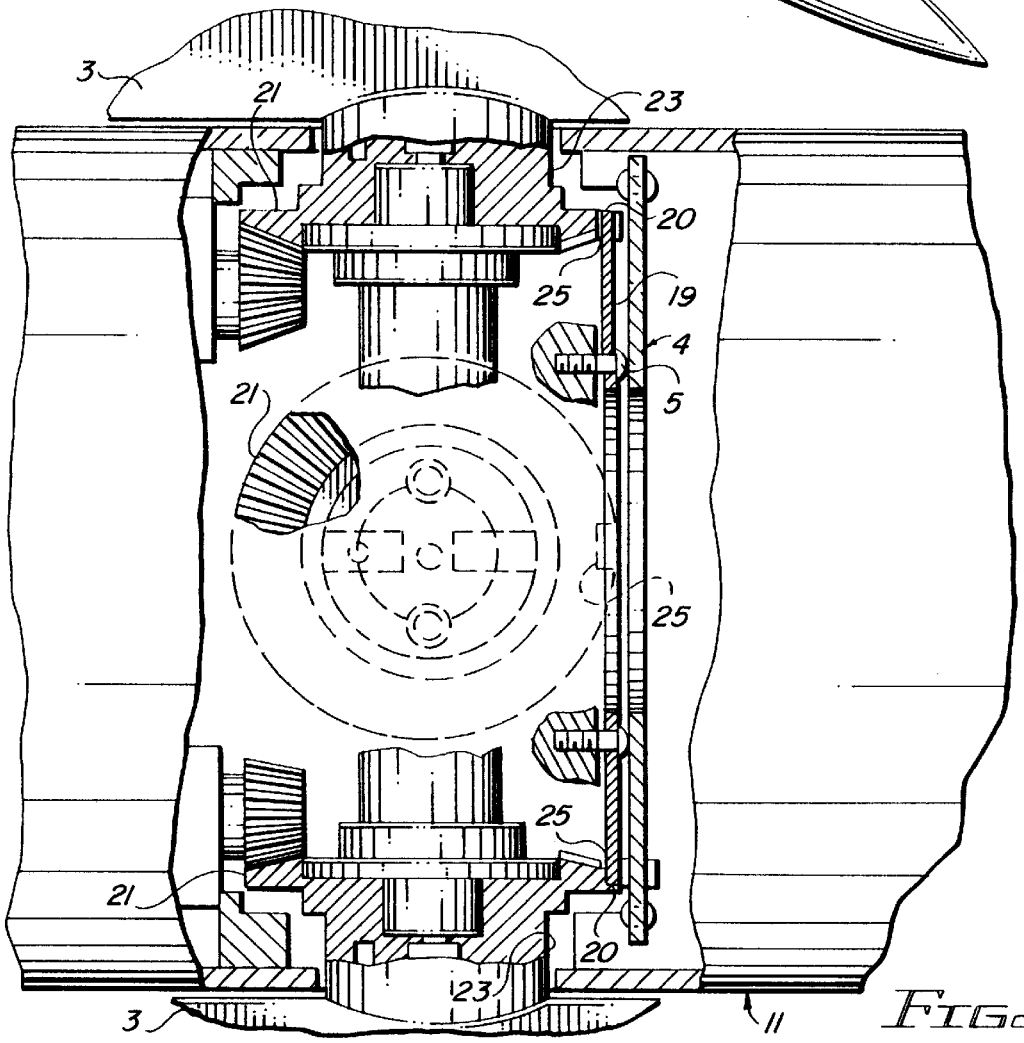
FIG. 2 is a partially broken away view along line 2—2 of FIG. 1 and shows a CAS system in conjunction with the fin lock mechanism of the invention.

FIG. 2 shows generally a Control Actuator System (CAS) used to effect steering of a missile 11 such as is depicted in FIG. 1. The CAS is contained within the missile body and communicates with steering fins 3, disposed exteriorly of the missile body, via output shafts 23. Motion of fins 3 is effected by rotation of output shafts 23 in accordance with command signals issued by the missile autopilot (not shown), the command signals serving to activate drive motors (not shown) mechanically linked to the output shafts via bevel gears 21. Further details of this CAS are presented in the above-referenced U.S. Pat. No. 5,505,408.

To lock output shafts 23 in place prior to missile flight, the CAS is provided with a locking plate 19 having a generally planar shape. As illustrated in FIG. 2, locking plate 19 is retained in place by bolts 5 passing through bolt holes 22 (FIG. 5) provided in the locking plate. Additionally, dowel pin holes 22A (FIG. 5) may also be provided for engagement with dowel pins (not shown) against. which locking plate 19 can be counter-rotated. Tabs 20, each associated with an output shaft 23, extend out from locking plate 19 along cantilevered arms 18. Each tab 20 is associated with an output shaft 23 of the missile, extending in the direction of the output shaft for engagement with a bevel gear 21 thereof. The tabs 20 fit into slots 25 machined into the output shaft bevel gears 21 and inhibit, in a locking position, rotation of the output shafts 23 and connected fins 3. The locking configuration presents an important feature of the present invention, wherein the tabs are pre-loaded into each output shaft bevel gear 21 by the spring action of arms 18, thus eliminating backlash due to dimensional variations and wear.

Figure 5:
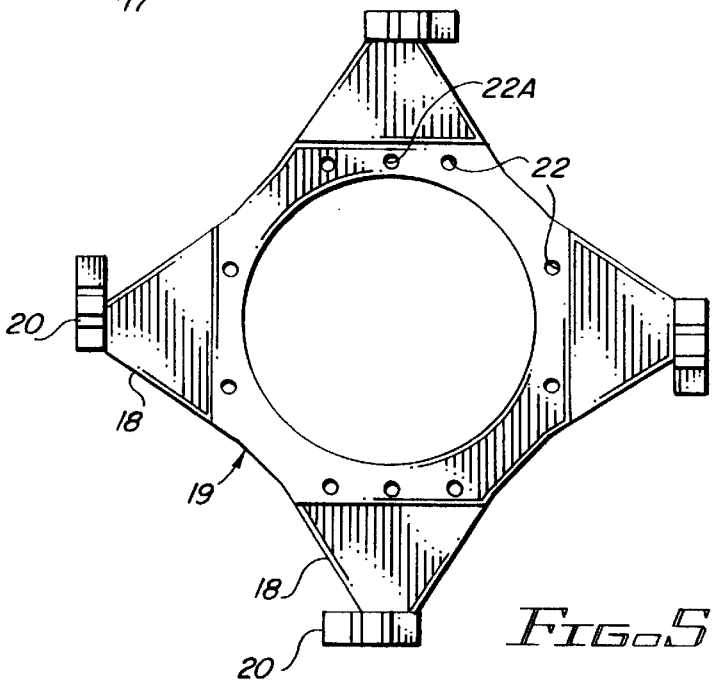
FIG. 5 is a schematic top view of the locking plate of FIG. 4.
Figure 6:
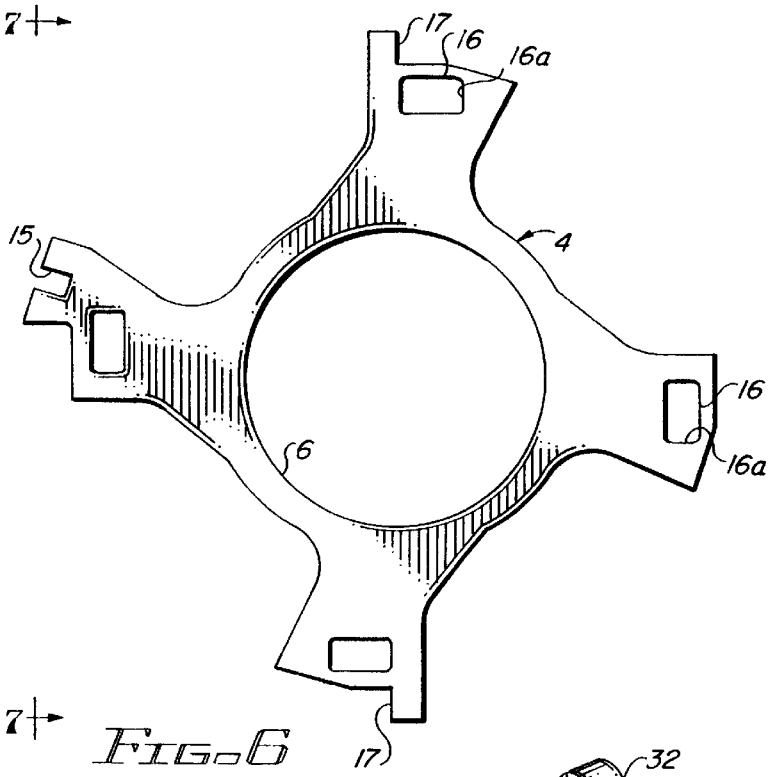
FIG. 6 is a schematic top view of the cam plate of the invention.
Figure 7:
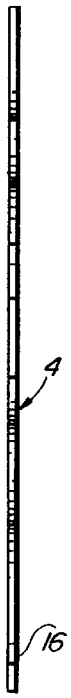
FIG. 7 is a schematic side view of the cam plate of FIG. 6.
Figure 4A:
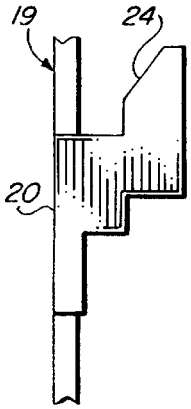
FIG. 4A is a detailed view of the circled region of FIG. 4 showing a ramp associated with a tab of the locking plate.
Figure 8:
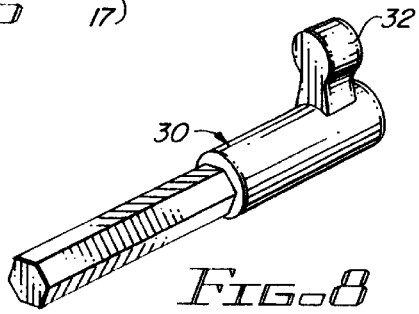
FIG. 8 is a perspective view of the manual locking and unlocking tool of the invention.
Figure 9:
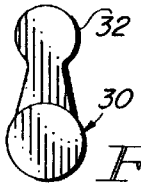
FIG. 9 is a side view of the manual locking tool of FIG. 8.

Unlocking of output shafts 23 is achieved through action of a cam plate 4 which is mounted for rotation relative to locking plates 19. Cam plate 4 has a bushing fitting 6 and rotates about a central axis. Ramps 24 (FIG. 6), provided on locking plate 19 in proximity to tabs 20, engage cam plate 4 during its rotation and operate to lift the cantilevered tabs 20 out of slots 25 by converting the rotary motion of cam plate 4 to an orthogonal motion of cantilevered tabs 20. The orthogonal motion occurs when engagement segments 16*a* of cam plate 4 slide along the surfaces of ramps 24, causing the orthogonal motion of the ramps and the attached tabs, thereby lifting tabs 20 out of slots 25 in the output shaft bevel gears 21. Engagement segments 16*a,* seen in FIG. 5, are the radial edges of windows 16 formed in cam plate 4 and in which ramps 24 travel. The number of these windows 16 of course corresponds to the number of ramps and tabs, which in turn corresponds to the number of fins to be locked by the mechanism. In this manner, the invention enables simultaneous unlocking of all the locked output shafts 23 for instant activation of the steering fins 3.

As an alternative design, ramps 24 may be disposed on cam plate 4 rather than on the locking plate 19. The locking mechanism otherwise operates in the same manner, with the ramps 24 serving to lift cantilevered tabs 20 out of slots 25 as the ramps rotatably slide against locking plate 19.

Figure 10A:
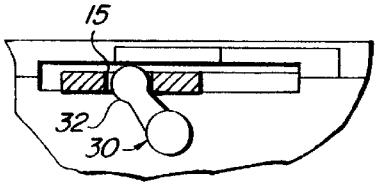
FIGS. 10A and 10B are operational views of the locking tool of FIG. 8 in engagement with the cam plate of FIG. 6.
Figure 10B:
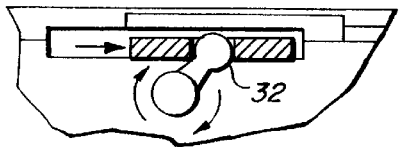

To effect rotation of cam plate 4, various expedients may be used. For manual operation, a tool 30 may be provided for insertion into the missile body for engagement with cam plate 4 as shown in FIGS. 10A and 10B. Specifically, cam plate 4 is provided with a clevis 15. A key interface 32, provided on tool 30, mates with clevis 15, transferring rotation of tool 30 to rotation of cam plate 4 and effecting locking or unlocking, depending on the rotation direction, of output shafts 23 and fins 3.

Figure 3:
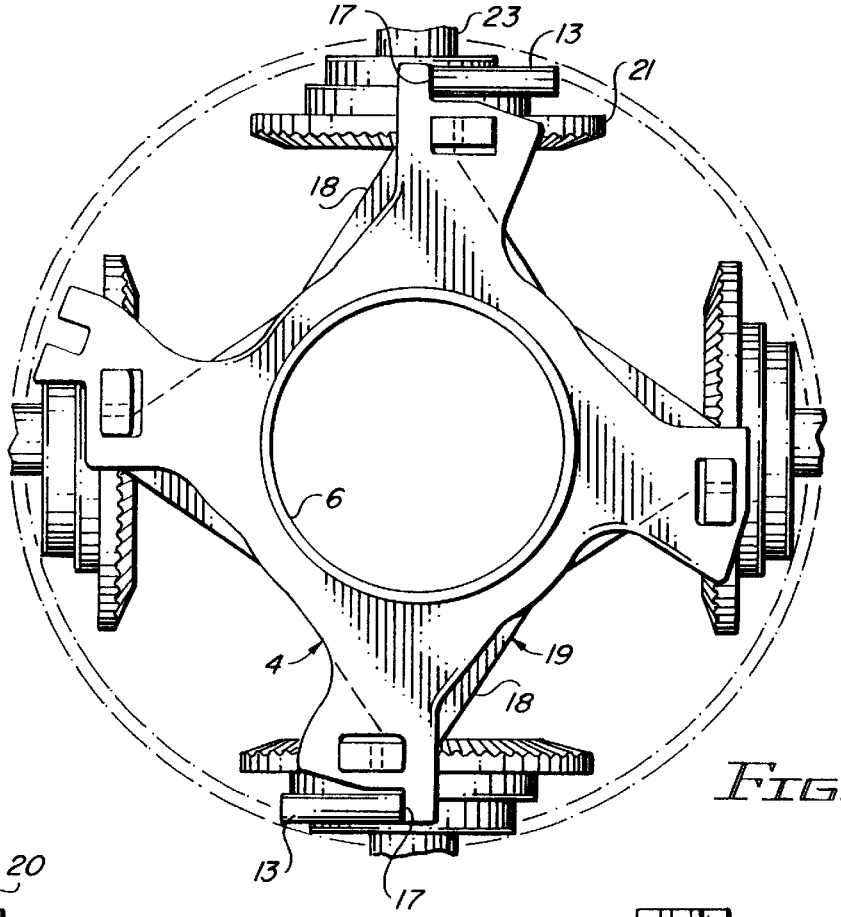
FIG. 3 is a top view of the locking mechanism of FIG. 2.
Figure 4:
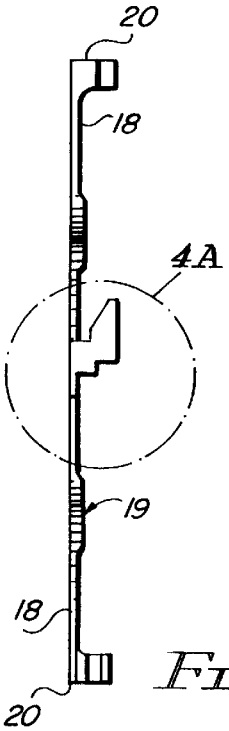
FIG. 4 is a schematic side view of the locking plate of the invention.

Cam plate 4 may also be rotated by action of at least one pyrotechnic device. Expanding gases ignited in a conventional pyrotechnic device move a piston 13, shown in FIG. 3, against an associated contact portion 17 disposed radially on cam plate 4. Contact portion 17, like clevis 15, operates to crank cam plate 4, causing it to rotate against ramps 24 and disengage the tabs 20 from the output shafts 23.

Although there have been described hereinabove various specific arrangements of a Fin Lock Mechanism in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A locking mechanism for locking missile fin output shafts comprising:

immobilizing means rigidly mounted at a first portion thereof within said missile and having movable portions adapted to engage said output shafts in a locking position to prevent rotation of said output shafts;

actuator means movably mounted within said missile and adapted to translate said movable portions between said locking position and a disengaged position; and drive means for driving said actuator means;

wherein said immobilizing means comprises a locking plate and said movable portions comprise a plurality of tabs, said tabs each being associated with a corresponding output shaft and engaging a slot formed on said corresponding output shaft to prevent rotation thereof in said locking position.

2. The device of claim 1, wherein said actuator means comprises a cam plate mounted for rotation relative to said locking plate, said rotation causing movement of said tabs.

3. The device of claim 2, wherein said movement of said tabs is effected by action of a plurality of ramps, each tab having a ramp associated therewith.

4. The device of claim 3, wherein said ramps are provided on said locking plate.

5. The device of claim 4, wherein said tabs are cantilevered on said locking plate.

6. The device of claim 5, wherein said drive means is a pyrotechnic device.

7. The device of claim 5, wherein said drive means is a tool engaging a receiving portion provided on said cam plate.

8. The device of claim 5, wherein rotation of said can plate causes simultaneous movement of said plurality of tabs.

9. A locking mechanism for locking a set of control fins of a missile against unwanted rotation, said mechanism comprising:

a plurality of output shafts each associated with a missile fin and having a slot formed thereon, said output shafts being rotatably mounted in said missile and adapted to rotate said associated missile fins;

a locking plate;

a plurality of tabs disposed on said locking plate, each tab corresponding to a slot on an associated output shaft and adapted to engage said slot to prevent rotation of said output shaft in a locked position;

a plurality of ramps each associated with a corresponding tab, said ramps adapted to move said tabs to a disengaged position out of engagement with said slots; and a movably mounted cam plate capable of moving said plurality of tabs into and out of engagement with said slots.

10. The device of claim 9, wherein said missile has a longitudinal missile axis and said cam plate is mounted for rotation about said missile axis, said rotation causing said cam plate to lift said ramps and said tabs to said disengaged position.

11. The device of claim 10, wherein said rotation is effected by movement of a release tool engaging said cam plate.

12. The device of claim 10, wherein said rotation is effected by a pyrotechnic device.

* * * * *